US008272759B2

(12) United States Patent
Chou

(10) Patent No.: US 8,272,759 B2
(45) Date of Patent: Sep. 25, 2012

(54) LIGHT-EMITTING DIODE LAMPSHADE

(75) Inventor: Min-Hwa Chou, Tainan (TW)

(73) Assignee: DBM Reflex of Taiwan Co., Ltd., Tainan (TW)

( * ) Notice: Subject to any disclaimer, the term of this patent is extended or adjusted under 35 U.S.C. 154(b) by 99 days.

(21) Appl. No.: 13/008,600

(22) Filed: Jan. 18, 2011

(65) Prior Publication Data

US 2012/0182743 A1 Jul. 19, 2012

(51) Int. Cl.
*F21V 1/00* (2006.01)

(52) U.S. Cl. ..... 362/241; 362/235; 362/245; 362/351; 362/329

(58) Field of Classification Search ..... 362/235, 362/240, 241, 242, 244, 245, 247, 248, 351
See application file for complete search history.

(56) References Cited

U.S. PATENT DOCUMENTS 6,367,949 B1 * 4/2002 Pederson ..... 362/240
7,303,316 B2 * 12/2007 Liu ..... 362/297
7,488,101 B2 * 2/2009 Brukilacchio ..... 362/554
7,506,998 B2 * 3/2009 Ansems et al. ..... 362/245
7,878,688 B2 * 2/2011 Paulussen et al. ..... 362/296.1
8,070,329 B1 * 12/2011 Bechtel et al. ..... 362/331
8,087,800 B2 * 1/2012 Bailey ..... 362/245
2002/0067548 A1 * 6/2002 TerHovhannisian ..... 359/627
2005/0128744 A1 * 6/2005 You et al. ..... 362/241
2006/0268556 A1 * 11/2006 Hsieh ..... 362/347
2010/0254127 A1 * 10/2010 Yang ..... 362/231
2011/0228534 A1 * 9/2011 Zhang et al. ..... 362/240

* cited by examiner

*Primary Examiner* — Ali Alavi
(74) *Attorney, Agent, or Firm* — Shimokaji & Associates P.C.

(57) ABSTRACT

An LED lampshade has a body and multiple light concentrators. The body has a light exit plane. The light concentrators are formed on the body. Each light concentrator has a light incident recess, a light transmitting recess and an third concentration wall. The light incident recess has a first concentration wall and a first chamber defined by the first concentration wall. The light transmitting recess corresponds to the light incident recess, and has a second concentration wall, a second chamber defined by the second concentration wall and opposite to the first chamber, and an opening formed through the light exit plane. The third concentration wall is formed around a periphery of the light concentrator. Given the opposite light incident recess and light transmitting recess and the three concentration walls, the LED lampshade enhances light transmittance and concentration therethrough.

20 Claims, 6 Drawing Sheets

LIGHT-EMITTING DIODE LAMPSHADE

BACKGROUND OF THE INVENTION

1. Field of the Invention

The present invention relates to a lampshade, and more particularly to a light-emitting diode (LED) lampshade having a shorter distance between a light incident portion and a light emitting portion, and enhanced light transmittance and concentration through the lampshade.

2. Description of the Related Art

A conventional LED lamp normally has a base, an LED module and a lampshade. The LED module is mounted on the base, and has a circuit board having LEDs mounted thereon. The lampshade is mounted on and covers the base, and has a body. The body has a light incident surface and a light emitting surface. The light incident surface is adjacent to the LEDs, and has multiple recesses. The recess is formed in the light incident surface, faces the LEDs, and has a circular light concentration wall inside the recess to define a chamber to hold a corresponding LED inside. The light emitting surface is a plane.

However, as light emitted by LEDs must be refracted by the light concentration wall and transmitted through the light emitting surface of the lampshade, and the distance between the recess and the light emitting surface is quite far, the light concentration performance is affected and luminance is dimmed. As a consequence, such a lampshade fails to satisfy the market demand.

SUMMARY OF THE INVENTION

An objective of the present invention is to provide an LED lampshade having a shorter distance between a light incident portion and a light emitting portion, and enhanced light transmittance and concentration therethrough.

To achieve the foregoing objective, the LED lampshade has a body and multiple light concentrators.

The body has a light exit plane.

The light concentrators are formed on the body. Each light concentrator has a light incident recess, a light transmitting recess and a second concentration wall. The light incident recess has a first concentration wall and a first chamber. The first chamber is defined by the first concentration wall. The light transmitting recess corresponds to the light incident recess, and has a second concentration wall, a second chamber and an opening. The second chamber is defined by the second concentration wall and oppositely faces the first chamber. The opening is formed through the light exit surface of the body. The third concentration wall is formed around a periphery of the light concentrator.

The LED lampshade can be mounted in an LED lamp and covers a lamp holder of the LED lamp. An LED module of the LED lamp is mounted between the LED lampshade and the lamp holder. The light concentrators of the LED lampshade respectively correspond to LEDs mounted on the LED module. Each LED can be inserted in the first chamber of the light incident recess. Light emitted from the LED can be concentrated and transmitted out through the light exit plane by reflection and/or refraction with the first concentration wall, the second concentration wall and the third concentration wall. Besides, the distance between the opposite light incident recess and light transmitting recess is shorter. Therefore, luminance and light concentration can be significantly enhanced by the LED lampshade.

Other objectives, advantages and novel features of the invention will become more apparent from the following detailed description when taken in conjunction with the accompanying drawings.

DETAILED DESCRIPTION OF THE INVENTION

Figure 1:
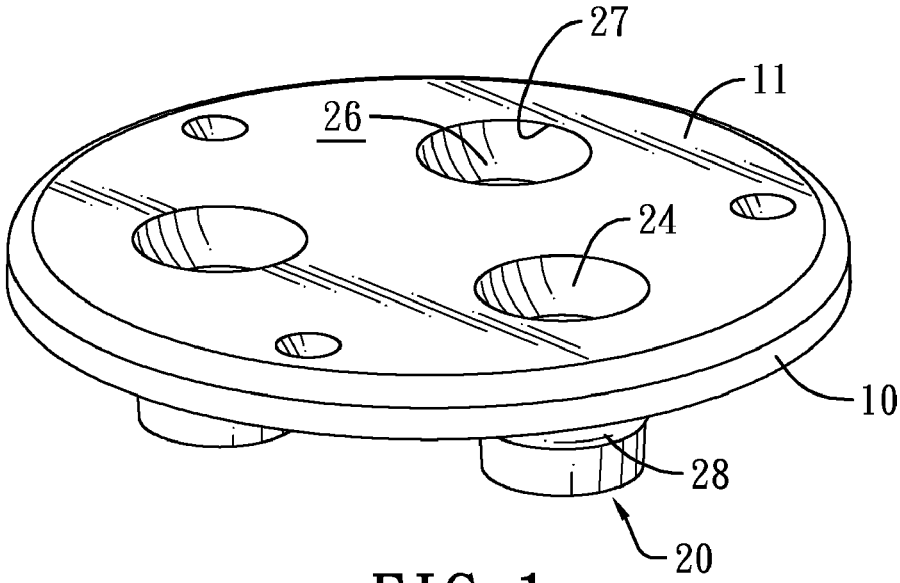
FIG. 1 is a perspective view of a first embodiment of an LED lampshade in accordance with the present invention.
Figure 2:
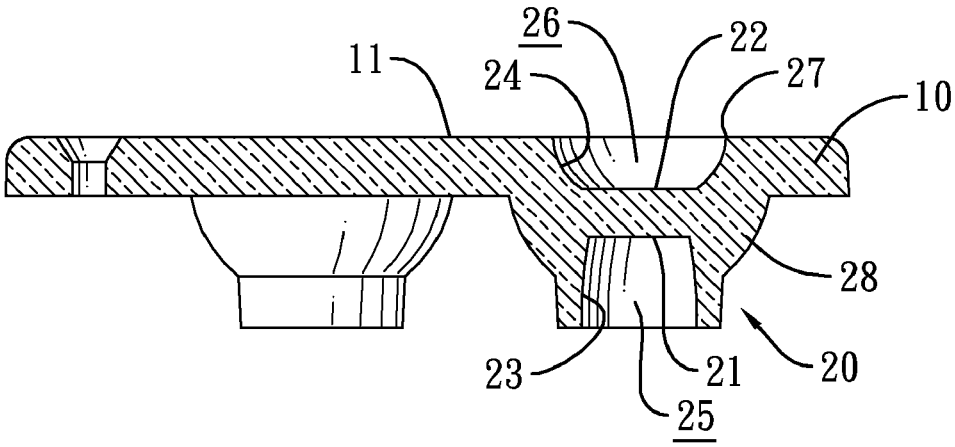
FIG. 2 is a cross sectional side view of the LED lampshade in FIG. 1.

With reference to FIGS. 1 and 2, a first embodiment of a light-emitting diode (LED) lampshade in accordance with the present invention has a body 10 and multiple light concentrators 20.

The body 10 has a light exit plane 11 formed on a top of the body 10. The light concentrators 20 are formed on the body 10, and each light concentrator 20 has a light incident recess 21 and a light transmitting recess 22. The light incident recess 21 has a first concentration wall 23 and a first chamber 25 defined by the first concentration wall 23. The light transmitting recess 22 corresponds to the light incident recess 21, and has a second concentration wall 24, a second chamber 26 and an opening 27. The second chamber 26 is defined by the second concentration wall 24 and oppositely facing the first chamber 25. The opening 27 is formed through the light exit plane 11. Each light concentrator 20 further has an third concentration wall 28 formed around a periphery of the light concentrator 20.

Figure 3:
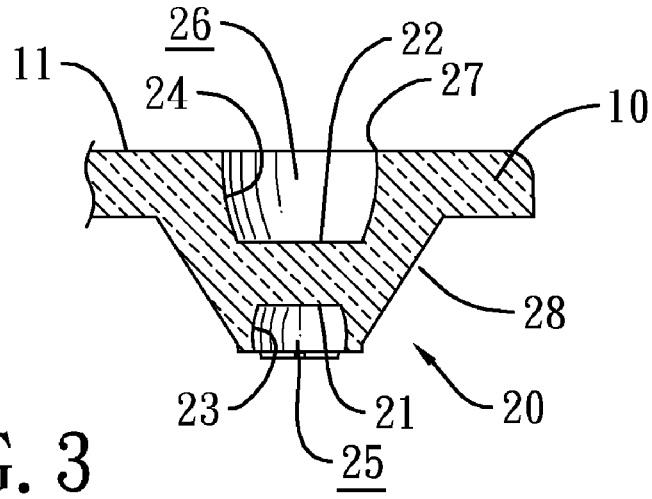
FIG. 3 is a partial cross sectional side view of a second embodiment of an LED lampshade in accordance with the present invention.
Figure 4:
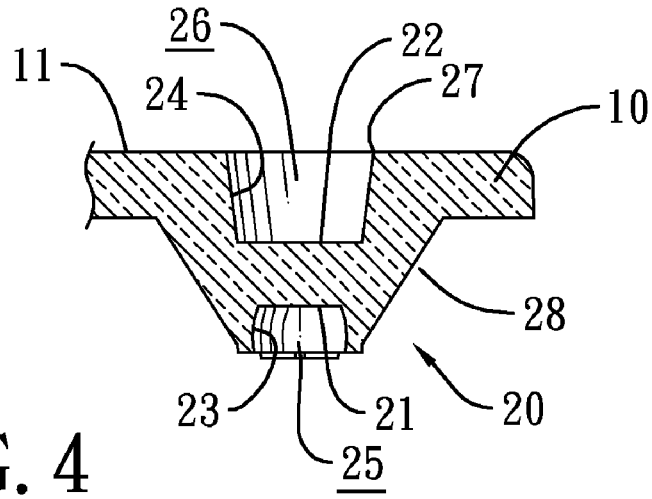
FIG. 4 is a partial cross sectional side view of a third embodiment of an LED lampshade in accordance with the present invention.
Figure 5:
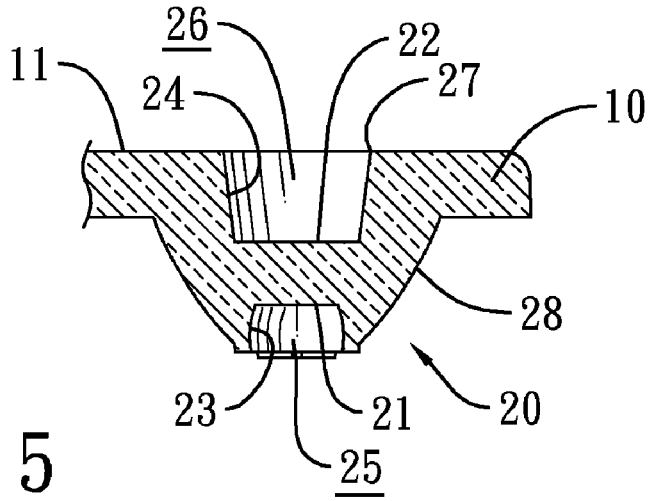
FIG. 5 is a partial cross sectional side view of a fourth embodiment of an LED lampshade in accordance with the present invention.
Figure 6:
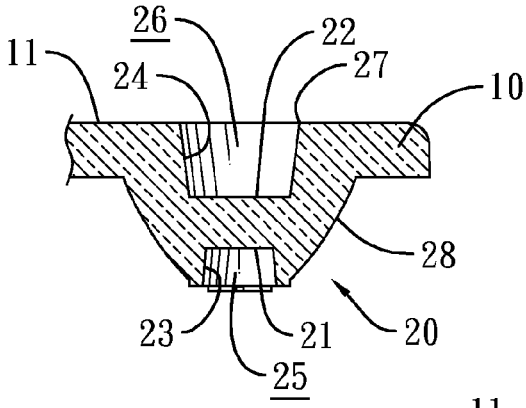
FIG. 6 is a partial cross sectional side view of a fifth embodiment of an LED lampshade in accordance with the present invention.
Figure 7:
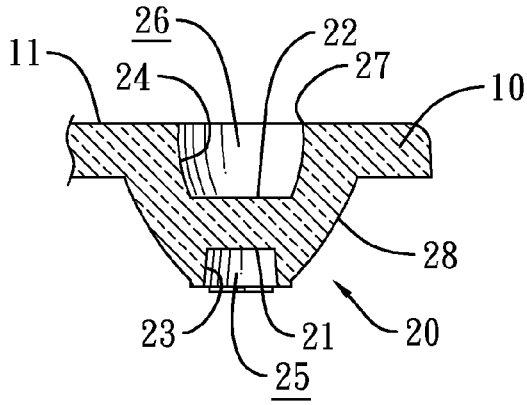
FIG. 7 is a partial cross sectional side view of a sixth embodiment of an LED lampshade in accordance with the present invention.
Figure 8:
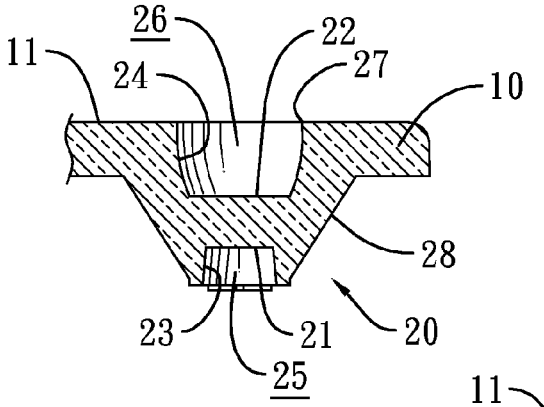
FIG. 8 is a partial cross sectional side view of a seventh embodiment of an LED lampshade in accordance with the present invention.
Figure 9:
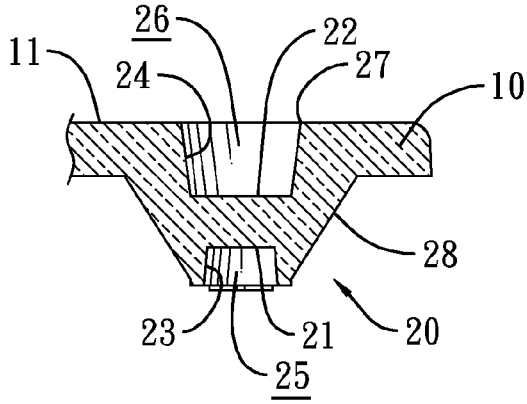
FIG. 9 is a partial cross sectional side view of an eighth embodiment of an LED lampshade in accordance with the present invention.

With reference to FIGS. 3 to 9, the second to eighth embodiments of LED lampshades in accordance with the present invention are shown. Each of the first concentration wall 23, the second concentration wall 24 and the third concentration wall 28 of the light concentrator 20 may be a lateral surface of a cone (referred to as a type A surface), a bowl-shaped curved surface (referred to as a type B surface) or the like. Specifically, the first concentration wall 23 shown in FIG. 2 is a type B surface, the second concentration wall 24 is a type B surface, and the third concentration wall 28 is a type B surface. In FIG. 3, the first concentration wall 23 is a type B surface, the second concentration wall 24 is a type B surface, and the third concentration wall 28 is a type A surface. In FIG. 4, the first concentration wall 23 is a type B surface, the second concentration wall 24 is a type A surface, and the third concentration wall 28 is a type A surface. In FIG. 5, the first concentration wall 23 is a type B surface, the second concentration wall 24 is a type A surface, and the third concentration wall 28 is a type B surface. In FIG. 6, the first concentration wall 23 is a type A surface, the second concentration wall 24 is a type A surface, and the third concentration wall 28 is a type B surface. In FIG. 7, the first concentration wall 23 is a type A surface, the second concentration wall 24 is a type B surface, and the third concentration wall 28 is a type B surface. In FIG. 8, the first concentration wall 23 is a type A surface, the second concentration wall 24 is a type B surface, and the third concentration wall 28 is a type A surface. In FIG. 9, the first concentration wall 23 is a type A surface, the second concentration wall 24 is a type A surface, and the third concentration wall 28 is a type A surface. When the first concentration wall 23 is a lateral surface of a cone or a bowl-shaped curved surface, diameters of cross-sections of the first concentration wall 23 decrease axially in a direction from the first chamber 25 to the second chamber 26. When the second concentration wall 24 or the third concentration wall 28 is a lateral surface of a cone or a bowl-shaped curved surface, diameters of cross-sections of the second concentration wall 23 or the third concentration wall 28 increase axially in a direction from the first chamber 25 to the second chamber 26. When each one of the first concentration wall 23, the second concentration wall 24 and the third concentration wall 28 is a bowl-shaped curved surface, the bowl-shaped curved surface may be asymmetric with respect to a center axis axially passing through the bowl-shaped curved surface. Each diametrical circle of the bowl-shaped curved surface may have multiple curvatures asymmetric with respect to a center axis axially passing through the bowl-shaped curved surface, and the curvatures of the diametrical circles of the bowl-shaped curved surface may be different.

Figure 10:
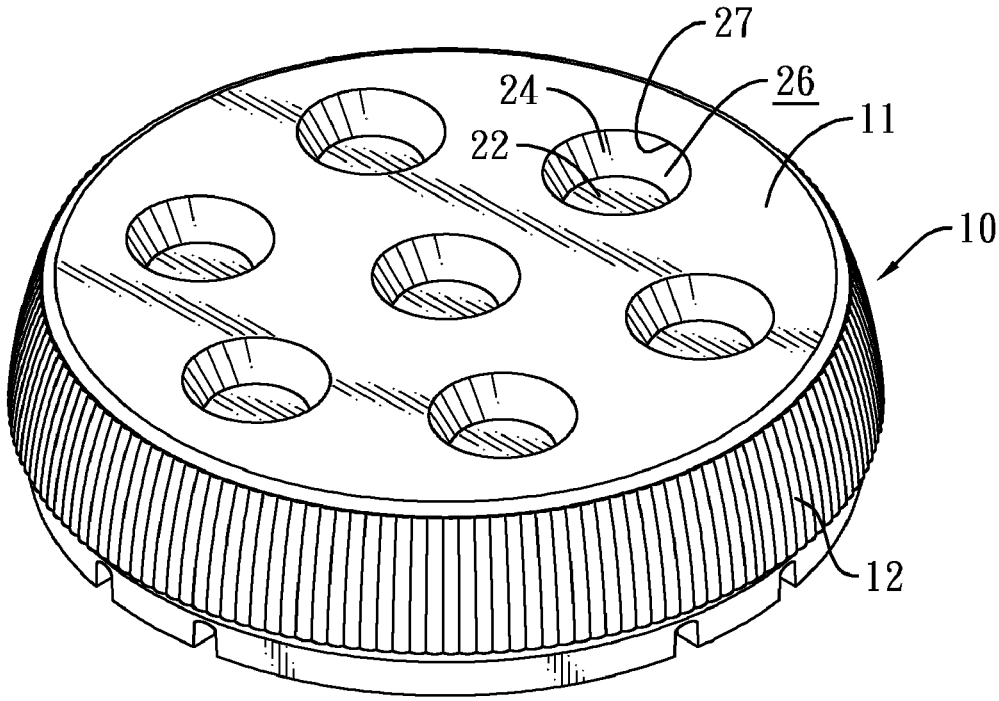
FIG. 10 is a perspective view of a ninth embodiment of an LED lampshade in accordance with the present invention.
Figure 11:
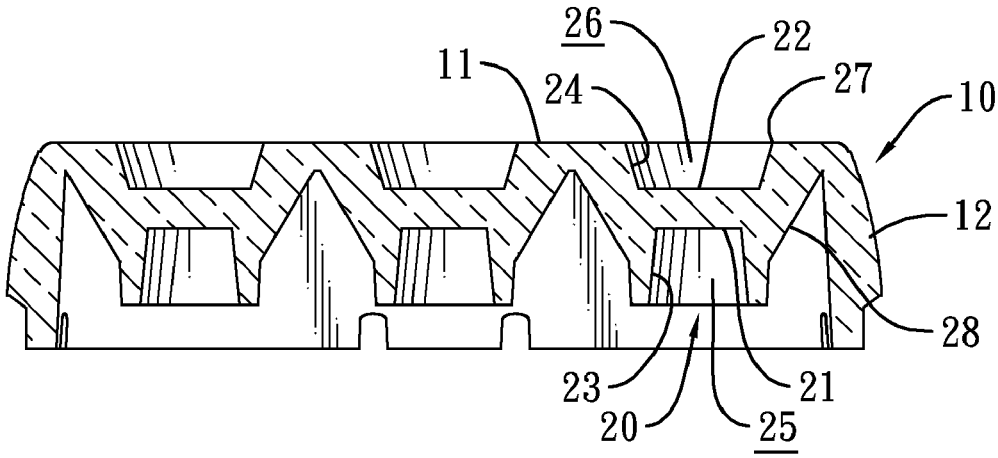
FIG. 11 is a cross sectional side view of the LED lampshade in FIG. 10.

With reference to FIGS. 10 and 11, a ninth embodiment of an LED lampshade in accordance with the present invention is shown. The body 10 may have three, five, seven or other numbers of light concentrators 20, and the body may further have a plurality of ribs 12 juxtaposedly formed on a periphery of a sidewall of the body.

Figure 12:
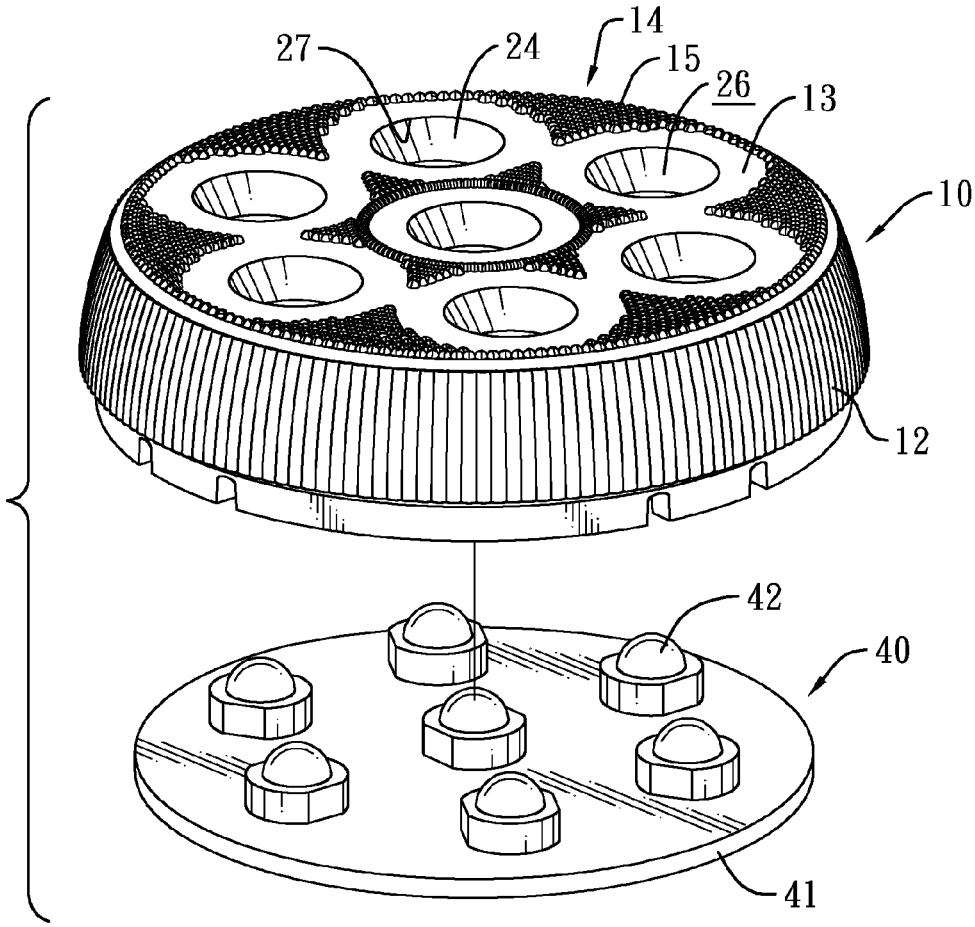
FIG. 12 is an exploded perspective view of a tenth embodiment of an LED lampshade in accordance with the present invention.
Figure 13:
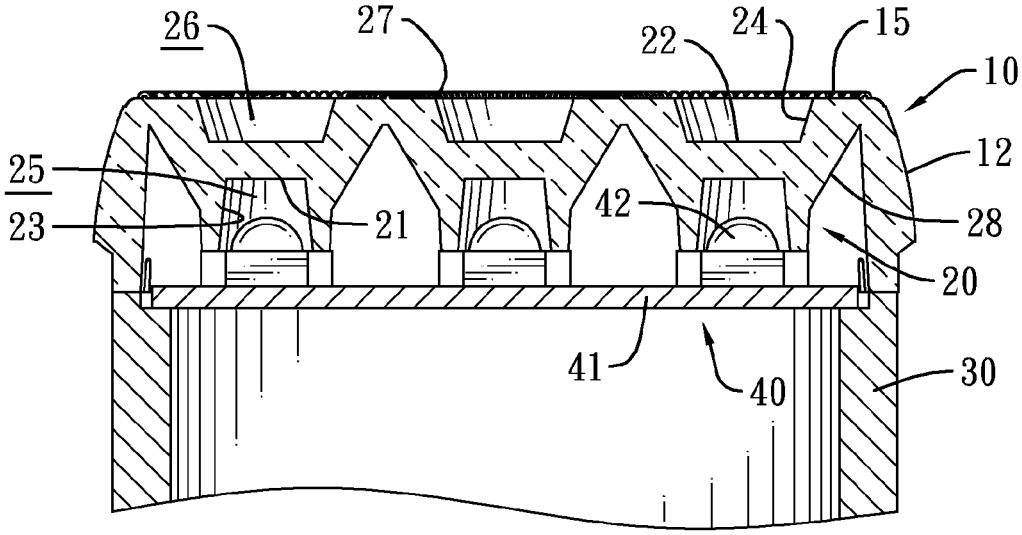
FIG. 13 is a side view in partial section of the LED lampshade in FIG. 11 mounted in a lamp holder.

With reference to FIGS. 12 and 13, a tenth embodiment of an LED lampshade in accordance with the present invention is shown. The body 10 further has a concentrated light area 13 and a uniform light area 14. The concentrated light area 13 is adjacent to the openings 27. The uniform light area 14 has a plurality of bumps 15 formed thereon. The lampshade is mounted to cover a lamp holder 30. An LED module 40 of an LED lamp is mounted between the lampshade and the lamp holder 30, and has a circuit board 41. The circuit board 41 has multiple LEDs 42 mounted thereon.

Each light concentrator 20 of the LED lampshade corresponds to and aligns with one of the LEDs 42 of the LED module 40. An emitting end of each LED 42 is inserted in the first chamber 25 of a corresponding light concentrator 20. Light emitted from the LED 42 can be emitted through the exit plane 11 of the body 10 of the LED lampshade through the following paths. Light emitted from the LED 42 is first reflected or refracted by the first concentration wall 23. The reflected light propagates to and is reflected again by the second concentration wall 24, and then is transmitted out of the light exit plane 11 of the body 10. The refracted light propagates to the third concentration wall 28, and is reflected or refracted by the third concentration wall 28. The reflected light propagates to and is reflected by the second concentration wall 24, and is transmitted out of the light exit plane 11 of the body 10. The refracted light propagates to and is refracted by the third concentration wall 28 of an adjacent light concentrator 20. The refracted light propagates to and is reflected by the second concentration wall 24, and is transmitted out of the light exit plane 11 of the body 10. According to the above light transmission paths, propagation angles of light transmitted from the LED 42 can be adjusted through the optical design of the first concentration wall 23, the second concentration wall 24 and the third concentration wall 28. As a result, light concentration can be effectively achieved by the light concentrator 20.

Each light concentrator 20 of the LED lampshade has the light incident recess 21 and the light transmitting recess 22 oppositely formed therein to shorten a gap between the light incident recess 21 and the light transmitting recess 22, so that light transmitted from the LEDs 42 can be more easily transmitted out through the light concentrator 20. Accordingly, the light transmittance and luminance of the LED lampshade is enhanced. Additionally, lights emitted from the LED lamp are more concentrated by reflection and/or refraction with the first concentration wall 23, the second concentration wall 24 and the third concentration wall 28. Accordingly, the LED lampshade of the present invention addresses an improved solution in terms of light transmittance and light concentration.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED lampshade, comprising:
- a body having a light exit plane; and
- multiple light concentrators formed on the body, each light concentrator having:
  - a light incident recess having:
    - a first concentration wall; and
    - a first chamber defined by the first concentration wall;
  - a light transmitting recess corresponding to the light incident recess, and having:
    - a second concentration wall;
    - a second chamber defined by the second concentration wall and oppositely facing the first chamber; and
    - an opening formed through the light exit surface of the body; and
    - an third concentration wall formed around a periphery of the light concentrator.

2. The LED lampshade as claimed in claim 1, wherein the first concentration wall of each light concentrator is a bowl-shaped curved surface, and diameters of cross-sections of the first concentration wall of each light concentrator decrease axially in a direction from the first chamber to the second chamber of the light concentrator.

3. The LED lampshade as claimed in claim 2, wherein each of the second concentration wall and the third concentration wall of each light concentrator is a lateral surface of a cone, diameters of cross-sections of each of the second concentration wall and the third concentration wall of each light concentrator increase axially in a direction from the first chamber to the second chamber of the light concentrator.

4. The LED lampshade as claimed in claim 3, wherein the body further has:

a concentrated light area being adjacent to the openings; and a uniform light area having a plurality of bumps formed on the uniform light area.

5. The LED lampshade as claimed in claim 2, wherein the second concentration wall of each light concentrator is a bowl-shaped curved surface, and diameters of cross-sections of the second concentration wall of each light concentrator increase axially in a direction from the first chamber to the second chamber of the light concentrator.

6. The LED lampshade as claimed in claim 5, wherein the third concentration wall of each light concentrator is a lateral surface of a cone, and diameters of cross-sections of the third concentration wall of each light concentrator increase axially in a direction from the first chamber to the second chamber of the light concentrator.

7. The LED lampshade as claimed in claim 6, wherein the body further has:

a concentrated light area being adjacent to the openings; and a uniform light area having a plurality of bumps formed thereon.

8. The LED lampshade as claimed in claim 2, wherein the third concentration wall of each light concentrator is a bowl-shaped curved surface, and diameters of cross-sections of the third concentration wall of each light concentrator increase axially in a direction from the first chamber to the second chamber of the light concentrator.

9. The LED lampshade as claimed in claim 8, wherein the second concentration wall of each light concentrator is a lateral surface of a cone, and diameters of cross-sections of the second concentration wall of each light concentrator increase axially in a direction from the first chamber to the second chamber of the light concentrator.

10. The LED lampshade as claimed in claim 9, wherein the body further has:

a concentrated light area being adjacent to the openings; and a uniform light area having a plurality of bumps formed thereon.

11. The LED lampshade as claimed in claim 5, wherein the third concentration wall of each light concentrator is a bowl-shaped curved surface, and diameters of cross-sections of the third concentration wall of each light concentrator increase axially in a direction from the first chamber to the second chamber of the light concentrator.

12. The LED lampshade as claimed in claim 1, wherein the second concentration wall of each light concentrator is a bowl-shaped curved surface, and diameters of cross-sections of the second concentration wall of each light concentrator increase axially in a direction from the first chamber to the second chamber of the light concentrator.

13. The LED lampshade as claimed in claim 12, wherein each of the first concentration wall and the third concentration wall of each light concentrator is a lateral surface of a cone, and diameters of cross-sections of each of the second concentration wall and the third concentration wall of each light concentrator increase axially in a direction from the first chamber to the second chamber of the light concentrator.

14. The LED lampshade as claimed in claim 13, wherein the body further has:

a concentrated light area being adjacent to the openings; and a uniform light area having a plurality of bumps formed thereon.

15. The LED lampshade as claimed in claim 12, wherein the third concentration wall of each light concentrator is a bowl-shaped curved surface, and diameters of cross-sections of the third concentration wall of each light concentrator increase axially in a direction from the first chamber to the second chamber of the light concentrator.

16. The LED lampshade as claimed in claim 15, wherein the first concentration wall of each light concentrator is a lateral surface of a cone, and diameters of cross-sections of the first concentration wall of each light concentrator decrease axially in a direction from the first chamber to the second chamber of the light concentrator.

17. The LED lampshade as claimed in claim 16, wherein the body further has:

a concentrated light area being adjacent to the openings; and a uniform light area having a plurality of bumps formed thereon.

18. The LED lampshade as claimed in claim 1, wherein the third concentration wall of each light concentrator is a bowl-shaped curved surface, and diameters of cross-sections of the third concentration wall of each light concentrator increase axially in a direction from the first chamber to the second chamber of the light concentrator.

19. The LED lampshade as claimed in claim 18, wherein each of the first concentration wall and the second concentration wall of each light concentrator is a lateral surface of a cone, diameters of cross-sections of the first concentration wall of each light concentrator decrease axially in a direction from the first chamber to the second chamber of the light concentrator, and diameters of cross-sections of the second concentration wall of each light concentrator increase axially in a direction from the first chamber to the second chamber of the light concentrator.

20. The LED lampshade as claimed in claim 1, wherein each of the first concentration wall, the second concentration wall and the third concentration wall of each light concentrator is a lateral surface of a cone, diameters of cross-sections of the first concentration wall of each light concentrator decrease axially in a direction from the first chamber to the second chamber of the light concentrator, and diameters of cross-sections of each of the second concentration wall and the third concentration wall of each light concentrator increase axially in a direction from the first chamber to the second chamber of the light concentrator.

* * * * *